US009290362B2

(12) United States Patent
Hey

(10) Patent No.: US 9,290,362 B2
(45) Date of Patent: Mar. 22, 2016

(54) REMOTE HEAVE COMPENSATION SYSTEM

(71) Applicant: National Oilwell Varco, L.P., Houston, TX (US)

(72) Inventor: John E. Hey, Spring, TX (US)

(73) Assignee: National Oilwell Varco, L.P., Houston, TX (US)

( * ) Notice: Subject to any disclaimer, the term of this patent is extended or adjusted under 35 U.S.C. 154(b) by 115 days.

(21) Appl. No.: 14/105,909

(22) Filed: Dec. 13, 2013

(65) Prior Publication Data

US 2014/0166604 A1 Jun. 19, 2014

Related U.S. Application Data

(60) Provisional application No. 61/736,979, filed on Dec. 13, 2012.

(51) Int. Cl.

| | |
|---|---|
| ***B66C 23/53*** | (2006.01) |
| ***B66C 13/04*** | (2006.01) |
| ***B66C 13/02*** | (2006.01) |

(52) U.S. Cl.

CPC ..... *B66C 23/53* (2013.01); *B66C 13/02* (2013.01); *B66C 13/04* (2013.01)

(58) Field of Classification Search

CPC ..... B66C 13/00; B66C 13/02; B66C 13/04; B66C 13/06; B66C 13/18

See application file for complete search history.

(56) References Cited

U.S. PATENT DOCUMENTS

| | | | |
|---|---|---|---|
| 13,976 | A | 12/1855 | Burnett |
| 1,582,274 | A | 4/1926 | Kaltenbach |
| 2,069,471 | A | 2/1937 | Baker |
| 2,414,573 | A | 1/1947 | Wagner et al. |
| 2,512,477 | A | 6/1950 | Bowes |
| 2,966,752 | A | 1/1961 | Wampach |
| 3,101,816 | A | 8/1963 | Fox |
| 3,292,981 | A | 12/1966 | Zaugg |
| 3,591,022 | A | 7/1971 | Polyakov et al. |

(Continued)

FOREIGN PATENT DOCUMENTS

| | | |
|---|---|---|
| DE | 1200216 | 9/1965 |
| FR | 769741 | 8/1934 |

(Continued)

OTHER PUBLICATIONS

International Search Report and Written Opinion for related PCT Application No. PCT/US2012/071763 mailed Mar. 22, 2013 (8 pages).

(Continued)

*Primary Examiner* — Sang Kim

*Assistant Examiner* — Juan Campos, Jr.

(74) *Attorney, Agent, or Firm* — Winthrop & Weinstine, P.A.

(57) ABSTRACT

A remote heave compensation system associated with a crane on a vessel may include a heave compensator arranged remotely from the crane and configured to translate in association with and to compensate for heaving motion of the vessel, an equalizer arranged on the crane and coupled to an end of a multiline system of the crane, a heave line secured to the equalizer at a first end and secured to the heave compensator at a second end, wherein compensating motion of the heave compensator is transferred to the equalizer by the heave line to compensate for heaving motion of the vessel and stabilize objects suspended from the multiline system of the crane.

17 Claims, 7 Drawing Sheets

(56) References Cited

U.S. PATENT DOCUMENTS

| | | | |
|---|---|---|---|
| 3,651,951 | A | 3/1972 | Murakami |
| 3,943,868 | A | 3/1976 | Person et al. |
| 3,967,867 | A | 7/1976 | Richardson |
| 3,977,531 | A | 8/1976 | Brewer |
| 4,039,177 | A | 8/1977 | Person et al. |
| 4,061,230 | A | 12/1977 | Goss et al. |
| 4,085,509 | A | 4/1978 | Bell et al. |
| 4,091,356 | A | 5/1978 | Hutchins |
| 4,104,608 | A | 8/1978 | Melling et al. |
| 4,135,841 | A | 1/1979 | Watkins |
| 4,155,538 | A | 5/1979 | Claassen |
| 4,180,171 | A | 12/1979 | Cunningham et al. |
| 4,184,600 | A | 1/1980 | Goss et al. |
| 4,210,897 | A | 7/1980 | Hutchins |
| 4,216,870 | A | 8/1980 | Bonneson et al. |
| 4,221,300 | A | 9/1980 | Rudak et al. |
| 4,223,961 | A | 9/1980 | Martinez |
| 4,271,578 | A | 6/1981 | Robinson et al. |
| 4,271,970 | A | 6/1981 | Miller et al. |
| 4,272,059 | A | 6/1981 | Noerager et al. |
| 4,354,606 | A | 10/1982 | Morrow et al. |
| 4,367,981 | A | 1/1983 | Shapiro |
| 4,382,361 | A | 5/1983 | Blanchet |
| 4,395,160 | A | 7/1983 | deJong |
| 4,428,421 | A | 1/1984 | Rankin |
| 4,432,420 | A | 2/1984 | Gregory et al. |
| 4,446,977 | A | 5/1984 | McClain |
| 4,448,396 | A | 5/1984 | Delago |
| 4,506,591 | A | 3/1985 | Blanchet |
| 4,513,869 | A | 4/1985 | Goudy |
| 4,524,875 | A | 6/1985 | Jamieson |
| 4,612,984 | A | 9/1986 | Crawford |
| 4,620,692 | A | 11/1986 | Foreman et al. |
| 4,633,951 | A | 1/1987 | Hill et al. |
| 4,648,729 | A | 3/1987 | Jones |
| 4,652,177 | A | 3/1987 | Gunther, Jr. et al. |
| 4,682,657 | A | 7/1987 | Crawford |
| 4,688,688 | A | 8/1987 | Volakakis et al. |
| 4,697,253 | A | 9/1987 | Lind et al. |
| 4,699,216 | A | 10/1987 | Rankin |
| 4,718,493 | A | 1/1988 | Hill et al. |
| 4,721,286 | A | 1/1988 | Hey et al. |
| 4,723,852 | A | 2/1988 | Ehret |
| 4,787,524 | A | 11/1988 | Cobb, III et al. |
| 4,830,107 | A | 5/1989 | Rumbaugh |
| 4,858,694 | A | 8/1989 | Johnson et al. |
| 4,892,202 | A | 1/1990 | Hey et al. |
| 4,905,763 | A | 3/1990 | Sauer et al. |
| 4,913,238 | A | 4/1990 | Danazcko et al. |
| 4,913,592 | A | 4/1990 | Petty et al. |
| 4,923,012 | A | 5/1990 | Hopmann |
| 4,928,770 | A | 5/1990 | Murray |
| 4,928,771 | A | 5/1990 | Vandevier |
| 4,934,870 | A | 6/1990 | Petty et al. |
| 4,962,817 | A | 10/1990 | Jones et al. |
| 5,028,194 | A | 7/1991 | Robinson |
| 5,048,642 | A | 9/1991 | Lloyd |
| 5,190,107 | A | 3/1993 | Langner et al. |
| 5,209,302 | A | 5/1993 | Robichaux et al. |
| H001232 | H | 9/1993 | DiSiena |
| 5,309,816 | A | 5/1994 | Weyer |
| 5,310,067 | A | 5/1994 | Morrow |
| 5,328,040 | A | 7/1994 | Morrow |
| 5,377,763 | A | 1/1995 | Pearce et al. |
| 5,487,478 | A | 1/1996 | Morrow |
| 5,509,513 | A | 4/1996 | Kiesel |
| 5,510,988 | A | 4/1996 | Majeed et al. |
| 5,551,803 | A | 9/1996 | Pallini, Jr. et al. |
| 5,558,467 | A | 9/1996 | Horton |
| 5,579,931 | A | 12/1996 | Zuehlke et al. |
| 5,660,235 | A | 8/1997 | Sola |
| 5,762,017 | A | 6/1998 | Groves |
| 5,803,613 | A | 9/1998 | Riedel et al. |
| 5,894,895 | A | 4/1999 | Welsh |
| 5,901,864 | A | 5/1999 | Morrow |
| 5,951,227 | A | 9/1999 | Calkins et al. |
| 5,971,619 | A | 10/1999 | Bourgeois-Jacquet et al. |
| 5,980,159 | A | 11/1999 | Kazim |
| 6,000,480 | A | 12/1999 | Eik |
| 6,082,947 | A | 7/2000 | Adamson |
| 6,189,621 | B1 | 2/2001 | Vail, III |
| 6,196,325 | B1 | 3/2001 | Connell et al. |
| 6,216,789 | B1 | 4/2001 | Lorsignol et al. |
| 6,241,425 | B1 | 6/2001 | Kazim |
| 6,354,380 | B1 | 3/2002 | Becnel et al. |
| 6,367,390 | B1 | 4/2002 | Okubo et al. |
| 6,367,553 | B1 | 4/2002 | Boyd |
| 6,412,554 | B1 | 7/2002 | Allen et al. |
| 6,422,408 | B1 | 7/2002 | Lissandre et al. |
| 6,450,546 | B1 | 9/2002 | Montgomery et al. |
| 6,467,593 | B1 | 10/2002 | Corradini et al. |
| 6,478,086 | B1 | 11/2002 | Hansen |
| 6,491,174 | B1 | 12/2002 | Day |
| 6,502,524 | B1 | 1/2003 | Hooper |
| 6,517,291 | B1 | 2/2003 | Pollack |
| 6,530,430 | B2 | 3/2003 | Reynolds |
| 6,530,691 | B2 | 3/2003 | Laenge |
| 6,557,713 | B1 | 5/2003 | Laenge |
| 6,592,297 | B2 | 7/2003 | Frijns et al. |
| 6,691,784 | B1 | 2/2004 | Wanvik |
| 6,712,560 | B1 | 3/2004 | Cottrell |
| 6,739,395 | B2 | 5/2004 | Reynolds |
| 6,789,981 | B2 | 9/2004 | Pollack |
| 6,817,422 | B2 | 11/2004 | Jordan |
| 6,836,707 | B2 | 12/2004 | Sowada et al. |
| 6,840,326 | B2 | 1/2005 | Shiyou |
| 6,913,084 | B2 | 7/2005 | Boyd |
| 6,915,849 | B2 | 7/2005 | Nuth |
| 6,926,259 | B1 | 8/2005 | Roodenburg et al. |
| 6,932,326 | B1 | 8/2005 | Krabbendam |
| 6,968,900 | B2 | 11/2005 | Williams et al. |
| 7,008,340 | B2 | 3/2006 | Williams et al. |
| 7,051,814 | B2 | 5/2006 | Goode et al. |
| 7,063,159 | B2 | 6/2006 | Patton et al. |
| 7,073,602 | B2 | 7/2006 | Simpson et al. |
| 7,328,811 | B2 | 2/2008 | Roodenburg et al. |
| 7,416,169 | B2 | 8/2008 | Noeske et al. |
| 7,487,954 | B2 | 2/2009 | Copp et al. |
| 7,624,882 | B2 | 12/2009 | Commandeur et al. |
| 7,891,508 | B2 | 2/2011 | Delago |
| 2002/0079278 | A1 | 6/2002 | Sanders et al. |
| 2002/0166698 | A1 | 11/2002 | Beato |
| 2002/0197115 | A1 | 12/2002 | Borseth |
| 2003/0070600 | A1 | 4/2003 | Hooper |
| 2003/0107029 | A1 | 6/2003 | Hanson et al. |
| 2004/0026081 | A1 | 2/2004 | Horton, III |
| 2005/0077049 | A1 | 4/2005 | Moe et al. |
| 2005/0087731 | A1 | 4/2005 | Scott |
| 2005/0179021 | A1 | 8/2005 | Selcer et al. |
| 2005/0211430 | A1 | 9/2005 | Patton et al. |
| 2005/0242332 | A1 | 11/2005 | Ueki et al. |
| 2006/0016605 | A1 | 1/2006 | Coles |
| 2006/0078390 | A1 | 4/2006 | Olsen et al. |
| 2009/0232625 | A1 | 9/2009 | Almeda et al. |
| 2009/0261052 | A1 | 10/2009 | Vasstrand |
| 2011/0017695 | A1 | 1/2011 | Vandenbulcke et al. |
| 2011/0253661 | A1 | 10/2011 | Smith et al. |
| 2012/0034061 | A1* | 2/2012 | Boroy ..... B63B 27/10 414/800 |
| 2012/0217063 | A1* | 8/2012 | Roodenburg ..... B66C 13/02 175/5 |
| 2013/0129452 | A1 | 5/2013 | Vehmeijer et al. |
| 2014/0263142 | A1* | 9/2014 | Billiot ..... B66C 13/04 212/272 |
| 2015/0259181 | A1* | 9/2015 | Billiot ..... F16F 13/00 267/73 |

FOREIGN PATENT DOCUMENTS

| | | |
|---|---|---|
| GB | 2168944 | 7/1986 |
| SU | 1337338 | 10/1985 |

(56) References Cited

FOREIGN PATENT DOCUMENTS

| | | |
|---|---|---|
| WO | 2008022125 | 2/2008 |
| WO | 2009038468 | 3/2009 |
| WO | 2010093251 | 8/2010 |

OTHER PUBLICATIONS

International Search Report and Written Opinion for related PCT Application No. PCT/US2013/074978 mailed Feb. 28, 2014 (6 pages).

"Cranes with Active Heave Compensation", National Oilwell Varco, copyright 2008 (6 pages).

"Deepwater Lowering Concepts: Existing Systems & Food for Thought", National Oilwell Varco, ExxonMobil Presentation, Feb. 23, 2011 (25 pages).

"Deepwater Lowering Concepts: Existing Systems & Food for Thought", National Oilwell Varco, ExxonMobil Presentation, Feb. 23, 2011 (23 pages).

"AmClyde™ DB-50 DWLS/AHC Deepwater Lowering System w/Active Heave Compensation Model 80-S/N CW-4084", Proposal No. 8377-4, prepared for J. Ray McDermott, Febuary 24, 2010 (35 pages).

"Deepwater Lowering Concepts w/Active Heave Compensation", AmClyde Equipment Schemes Presentation, Jun. 23, 2007 (24 pages).

"Hydralift™ 250 MT Crane w/AHC 'Normand Clipper'", Mar. 24, 2006 (5 pages).

* cited by examiner

REMOTE HEAVE COMPENSATION SYSTEM

CROSS-REFERENCE TO RELATED APPLICATIONS

The present application claims priority to U.S. Provisional Patent Application No. 61/736,979 filed on Dec. 13, 2012, entitled Remote Heave Compensation System, the content of which is hereby incorporated by reference herein in its entirety.

FIELD OF THE INVENTION

The present application relates generally to systems for monitoring floating vessels and responding to cyclical and sometimes unexpected motions. Still more particularly, the present application relates to systems for monitoring motion of floating vessels and compensating for the effect of such motion on cranes. Still more particularly, the present application relates to a system for providing heave compensation for cranes arranged on floating vessels, the heave compensation being adapted for reducing the effect on an object suspended from a crane that is oscillating due to wave action.

BACKGROUND

Heave compensation systems may be provided to monitor motions of the sea and for causing line payout or haul in of a crane line in response to the motion. The compensation allows an object that is suspended from the line to remain substantially stationary below the surface and the compensation also helps to reduce the load on the line due to the heaving sea.

Many cranes use multiline systems for lowering or raising objects on and off of a vessel and/or to and from deep locations below the sea surface. To accommodate the multiline systems and avoid intricate and excessive line handling systems, portions of current heave compensation systems may be mounted on the boom of the crane. In addition, a large amount of hydraulic equipment and piping may be mounted near the base of the crane for controlling the portion that is on the boom.

These systems cause a large mass of equipment to be located relatively high on a vessel affecting the stability of the vessel. In addition, the systems may be integrated into the multiline system such that line wear occurring at or near the heave compensation system may require the full line to be replaced. Moreover, much of the line may commonly be below water and unavailable for inspection. Still further, the portion of the system that is located on the boom can take away from the overall capacity of the crane boom on which it is mounted.

SUMMARY

In one embodiment, a crane having a remote heave compensation system may be provided. The crane may include a base, a crane boom extending from the base, and a multiline system arranged on the crane for raising and lowering objects from the crane boom. The crane may also include a remote heave compensation system associated with the crane boom. The remote heave compensation system may include a heave compensator configured to translate in association with and to compensate for heaving motion of a vessel. The heave compensation system may also include an equalizer arranged on the crane boom and coupled to an end of the multiline system. The heave compensation system may also include a heave line secured to the equalizer at a first end and secured to the heave compensator at a second end. Compensating motion of the heave compensator may be transferred to the equalizer by the heave line to compensate for heaving motion of the vessel and stabilize objects suspended from the multiline system.

In another embodiment, a remote heave compensation system may be associated with a crane on a vessel. The system may include a heave compensator configured to translate in association with and to compensate for heaving motion of the vessel. The system may also include an equalizer arranged on the crane and coupled to an end of a multiline system of the crane. The system may also include a heave line secured to the equalizer at a first end and secured to the heave compensator at a second end. Compensating motion of the heave compensator may be transferred to the equalizer by the heave line to compensate for heaving motion of the vessel and stabilize objects suspended from the multiline system of the crane.

While multiple embodiments are disclosed, still other embodiments of the present teachings will become apparent to those skilled in the art from the following detailed description, which shows and describes illustrative embodiments. As will be realized, the teachings are capable of modifications in various aspects, all without departing from the spirit and scope of the present teachings. Accordingly, the drawings and detailed description are to be regarded as illustrative in nature and not restrictive.

DETAILED DESCRIPTION

The present application, in some embodiments, relates to a remote heave compensation system for a crane on a vessel. The remote heave compensation system may be associated with a crane, but the compensator portion of the system may be arranged remote from the crane boom and below the deck of the vessel, for example. The system may include a heave line that extends from the compensator portion of the system, to the pedestal or base of the crane, along the crane boom, and upwards to an equalizer, which is connected to the lifting lines of the crane. Accordingly, the compensator portion of the system may be placed in a remote location and, yet, may maintain operable coupling to the lifting lines to compensate for heaving motions of the vessel.

Locating the compensator portion of the heave compensation device below the deck of the vessel may be advantageous for several reasons. First, there are generally heavy hydraulic systems that allow the compensator to function and these systems may now be placed at a lower elevation on the vessel thereby helping to stabilize the vessel. Relocating the hydraulic systems may also free up available space at or around the base of the crane. Second, known systems may include locating a portion of the compensator on the boom. By relocating the compensator portion of the system below the deck of the vessel the dead loads on the boom may be reduced thereby freeing up capacity of the crane for lifting larger live loads. Still further, placing the compensator below deck allows for shorter piping runs between components. Placing the components below deck allows for better physical arrangement with shorter hydraulic piping runs.

In addition to the location of the compensator being below deck, the present system is advantageous because, when compared to known systems, the amount of line that is involved in the compensation system may be reduced by isolating the lifting lines from the heave compensation lines. This is advantageous because the limited amount of line involved in the compensation process allows for operators to develop known areas of wear. In addition, these known areas of wear may be in the open viewable space along the crane boom and not below water or otherwise obstructed from view. Accordingly, the heave line may be more easily monitored for wear. Still further, because the compensation system lines are isolated from the lifting lines, the heave compensation lines may be considerably shorter and, as such, may be more easily and cost-effectively replaced. That is, the whole spool of lifting line (thousands of feet of line) may not need to be replaced, but rather, a much shorter line extending from the equalizer to the compensator may be replaced.

Figure 1:
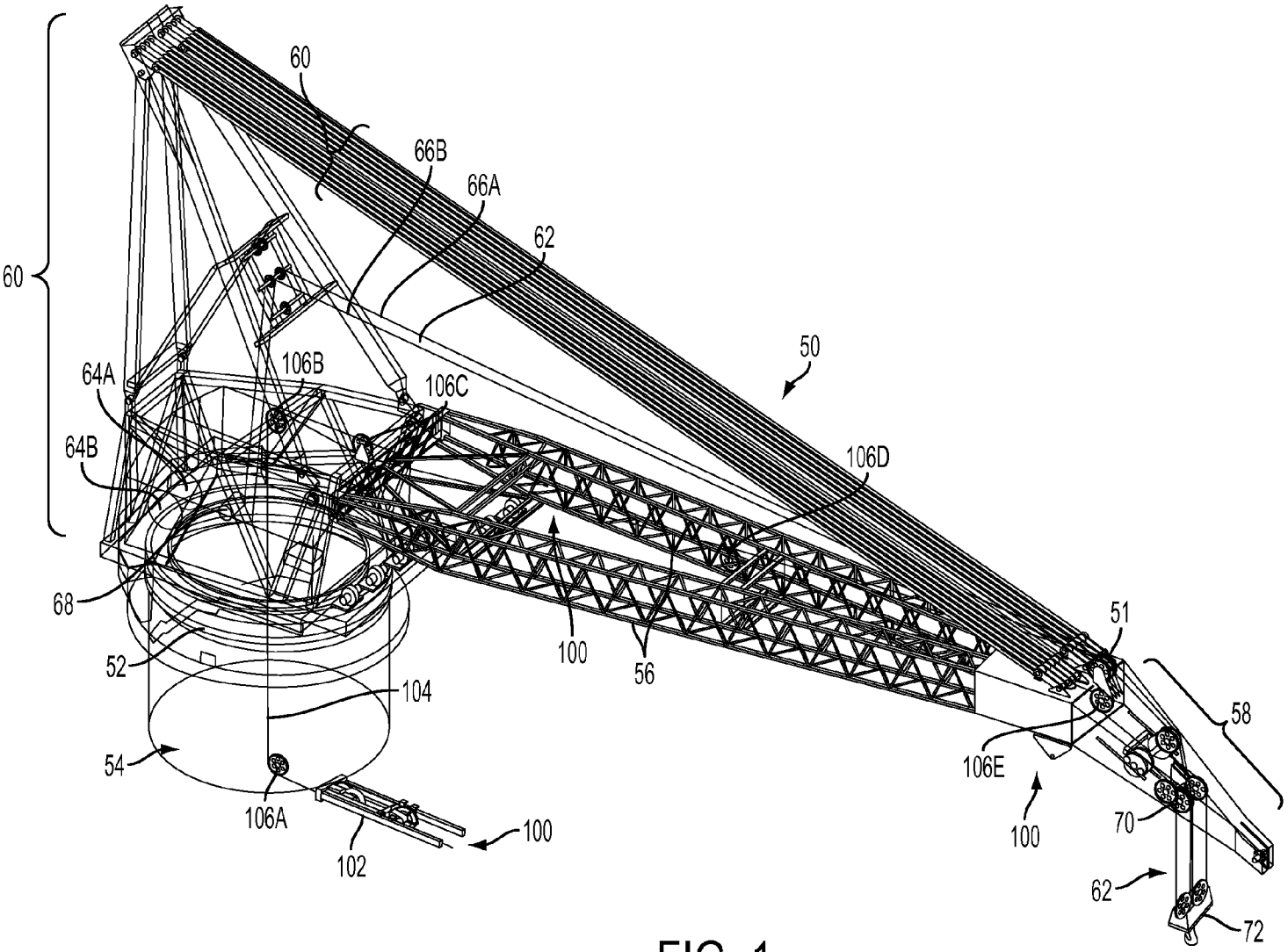
FIG. 1 is a perspective view of a crane on a pedestal with a remote heave compensation system having an equalizer in a forward position, according to some embodiments.
Figure 2:
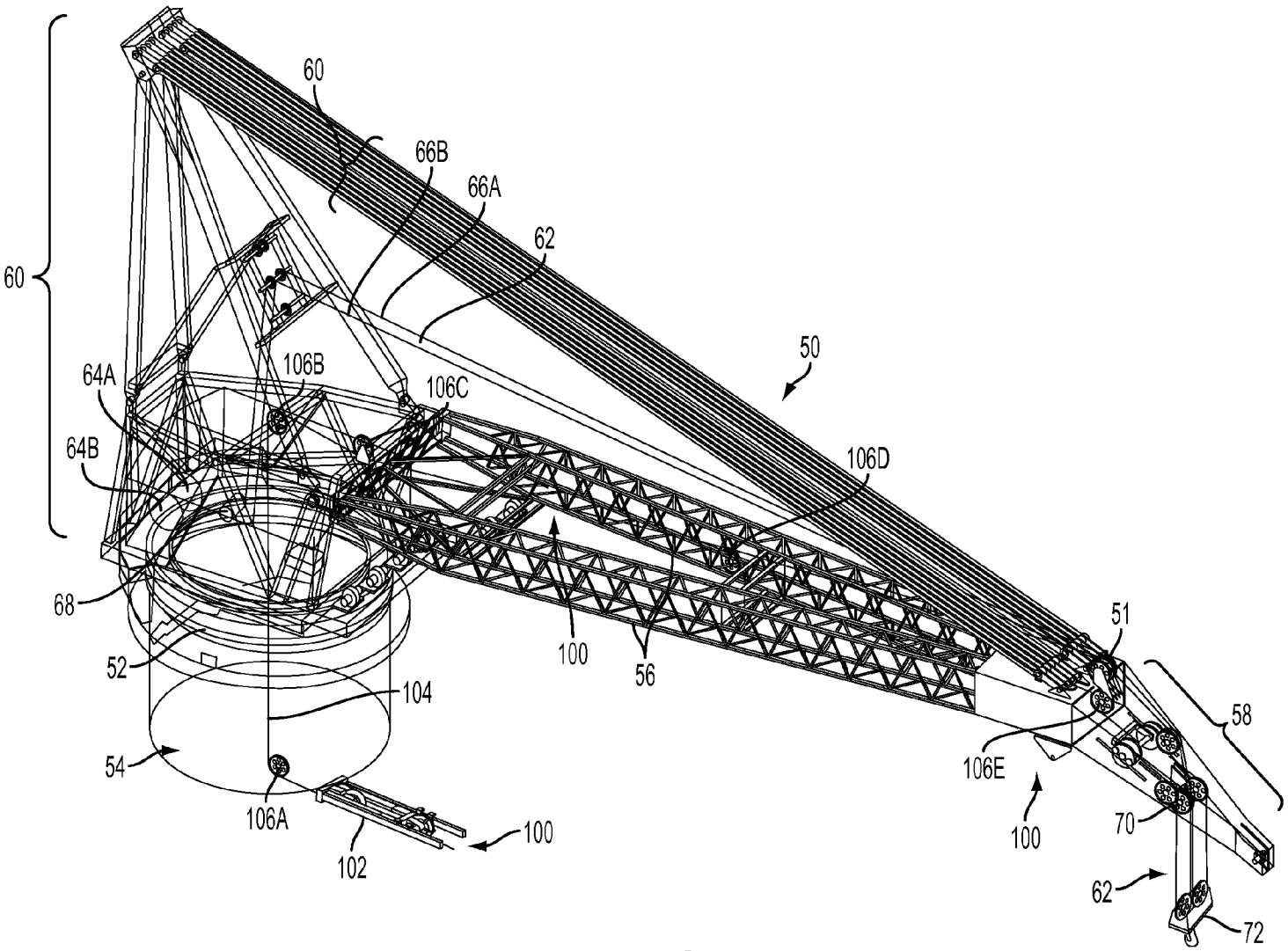
FIG. 2 is a perspective view of the crane of FIG. 1 with the equalizer in a middle position, according to some embodiments.
Figure 3:
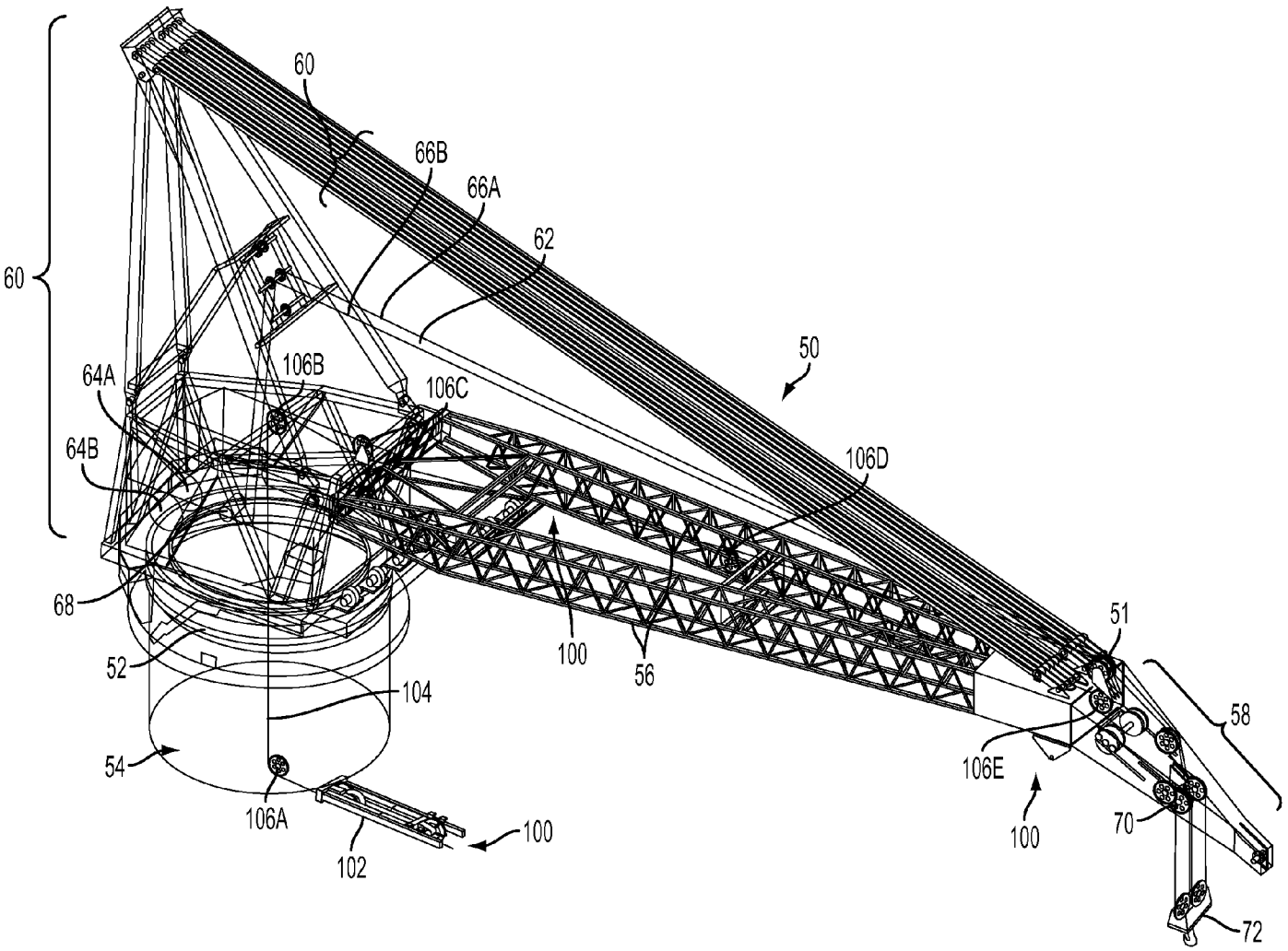
FIG. 3 is a perspective view of the crane of FIG. 1 with the equalizer in a rear position, according to some embodiments.

Referring now to FIGS. 1-3, a crane 50 having a remote heave compensation system 100 arranged thereon is shown. As shown, the crane 50 may include a crane base 52 arranged on a pedestal 54 of the vessel. The crane 50 may also include a boom 56 with a boom tip 58, a tie back system 60, and a lifting/lowering line system 62. The crane 50 may be configured for lifting objects onto or off of a ship, vessel, or platform, and may also be configured for lowering or raising objects to and from the sea floor. It is to be appreciated that while a substantially large A-frame type crane 50 is shown, other types of cranes may be provided in conjunction with the remote heave compensation system 100 described herein. For example, in some embodiments, a knuckle boom crane or other type of crane may be provided and the remote heave compensation system 100 may be provided together with that type of crane.

For purposes of further discussion of the remote heave compensation system 50, a brief discussion of the parts of the crane 50 of FIGS. 1-3 may be provided. The pedestal 54 may include a relatively cylindrical structure arranged on a vessel. The cylindrical structure may define a substantially vertical axis and may be configured for supporting the crane 50 off of the vessel. The cylindrical structure may include a cap arranged at its top for supporting the crane 50 on the cylindrical structure. The cylindrical structure may be generally hollow and the cap may include a series of hatches or penetrations allowing for lines of the crane 50, access stairways, passageways, power, hydraulic lines, and other items to pass between the crane 50 and areas below the deck of the vessel.

The crane 50 may be arranged on the pedestal 54 and may include a crane base 52 for supporting the boom 56 and the tie back system 60 relative to the pedestal 54. The crane base 52 may be operable to pivot about the vertical axis of the pedestal 54 or another vertical axis substantially parallel to the pedestal axis. The boom 56 may extend from the crane base 52 and may be pivotable in a vertical plane and operable to pivot from a substantially vertical position, or beyond, down to a substantially horizontal position, or beyond. The boom 56 may be configured for supporting the loads of the lifting lines 62 through compression and may be maintained in a given selected position by the tie back lines. The tieback system 60 may include a plurality of structural framing members supporting a plurality of tie back lines extending from the framing out to a location near the boom tip 58. The tie back lines may be configured for tensile forces and for tying back the boom tip 58 in resistance of line loads.

The crane 50 may also include a lifting line system 62. This line system 62 may include one of several different lifting line arrangements. In the embodiments shown, a multiline system in the form of a deep water lowering system of lifting lines 62 is shown. In this embodiment, a spool 64A of right lay line 66A and a spool 64B of left lay line 66B may each be provided and located at or near the crane base 52. Each of the lines 66 may extend from the spool or drum 64, through a traction winch 68, and upward along the crane boom 56 via a series of sheaves to a boom tip sheave 70. The lines 66 may pass across the boom tip sheave 70 and may extend downward to a load block 72 where an object to be lifted may be supported off of a crane hook attached to the load block 72. Each of the lines 66 may pass across one or more sheaves in the load block 72 and may then extend upwardly to the boom tip 58 where the lines 66 may each pass across an alignment sheave 74 and extend to an equalizer 76. In one embodiment, the lifting lines may include 60 mm diameter rope having a capacity of 325 MT B.S. Other line diameters and sizes may also be provided.

It is noted that this arrangement of right and left lay line 66A/66B, each having an outgoing and incoming portion, may help to resist twisting of the line under load and at great depths. More information regarding deep water lowering systems may be found in U.S. patent application Ser. No. 13/728,040, filed Dec. 27, 2012 and entitled Deep Water Knuckle Boom Crane, the content of which is hereby incorporated by reference herein in its entirety. However, other lifting line arrangements may also be used including single line systems with no portion returning from the load block 72 and single line systems with a portion returning from the load block 72. Still other lifting line arrangements including larger numbers of lines and/or outgoing and incoming portions of lines may be provided.

Figure 4:
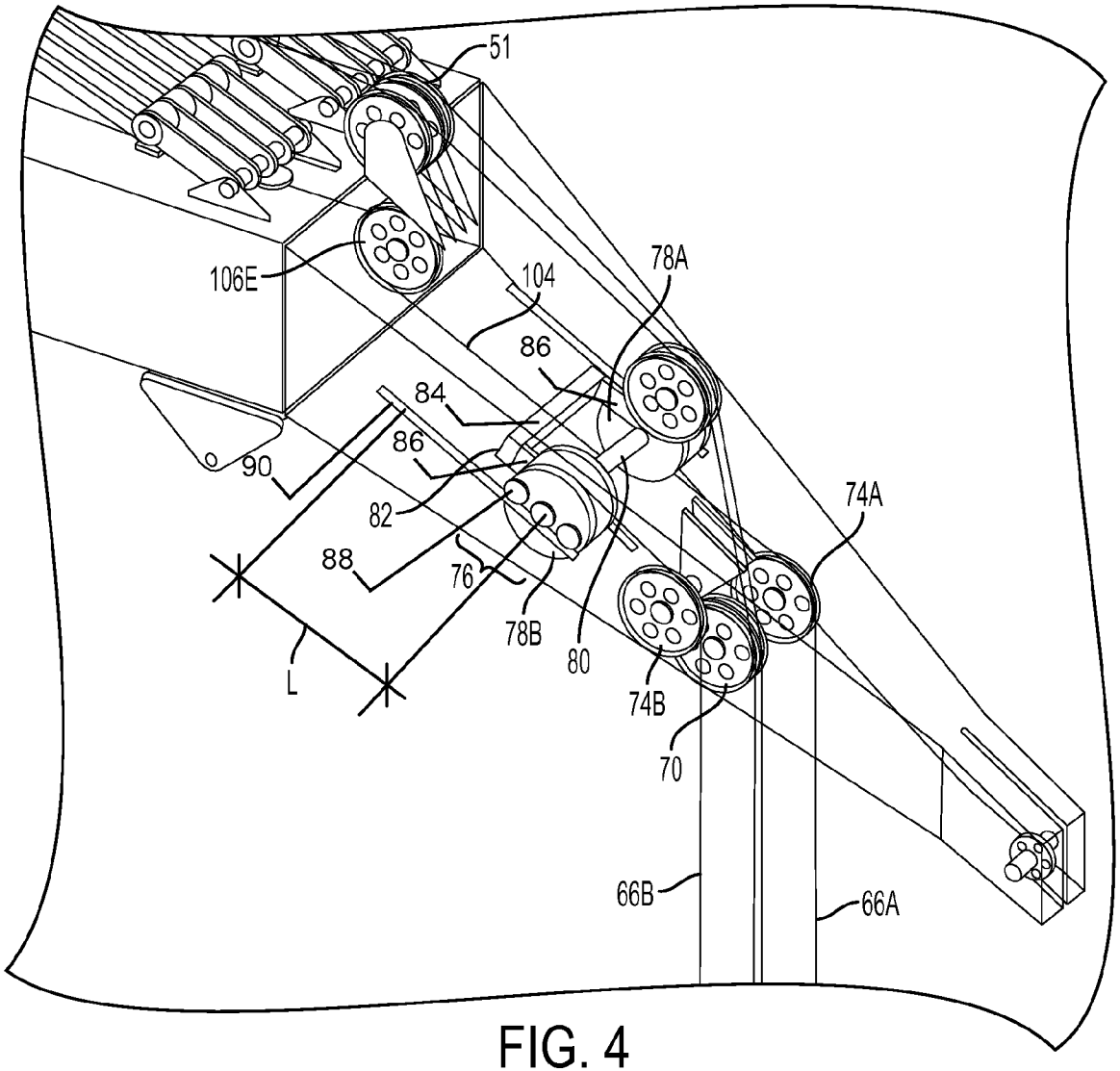
FIG. 4 is a close-up view of a boom tip of FIG. 1.
Figure 5:
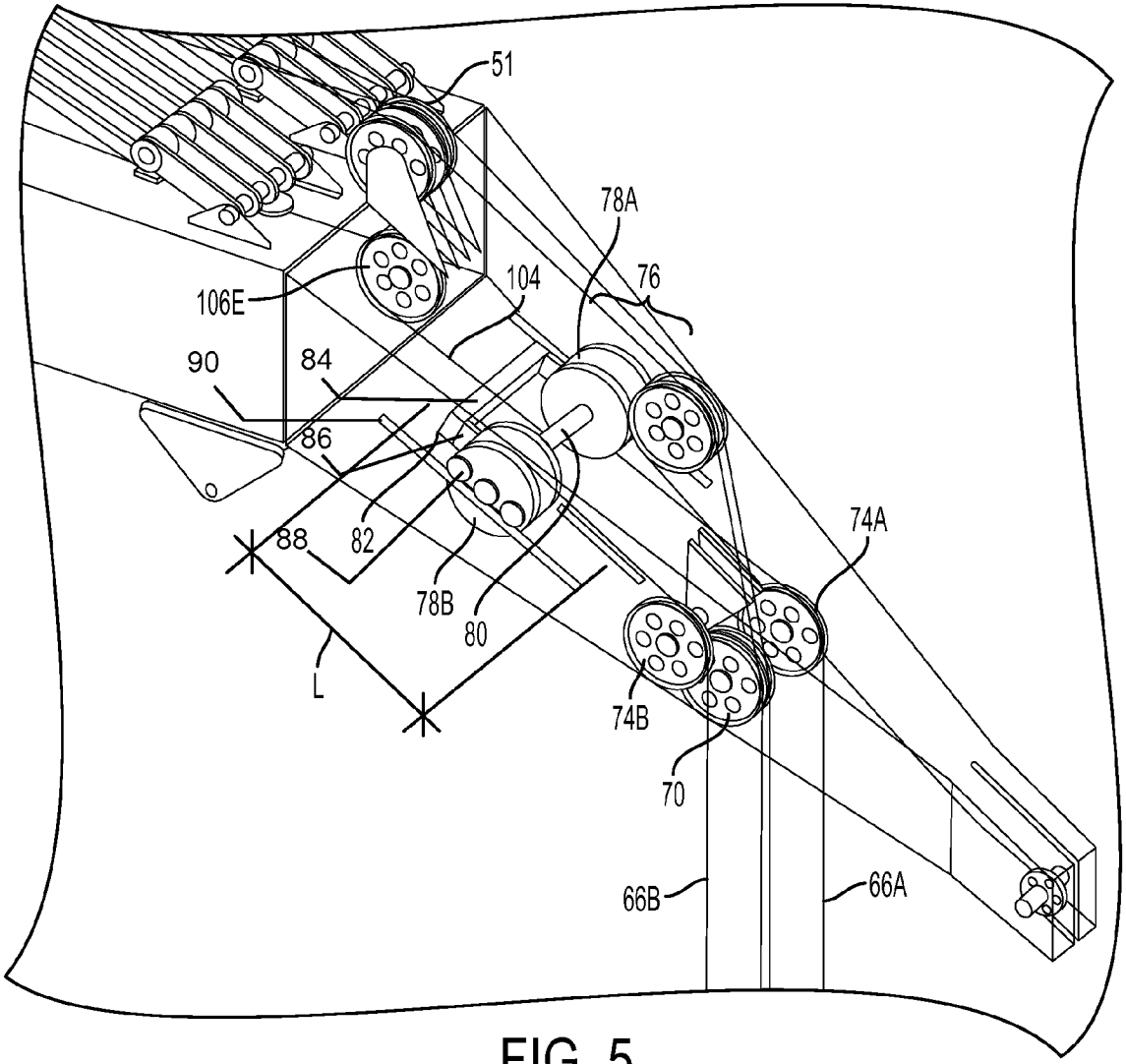
FIG. 5 is a close-up view of a boom tip of FIG. 2.
Figure 6:
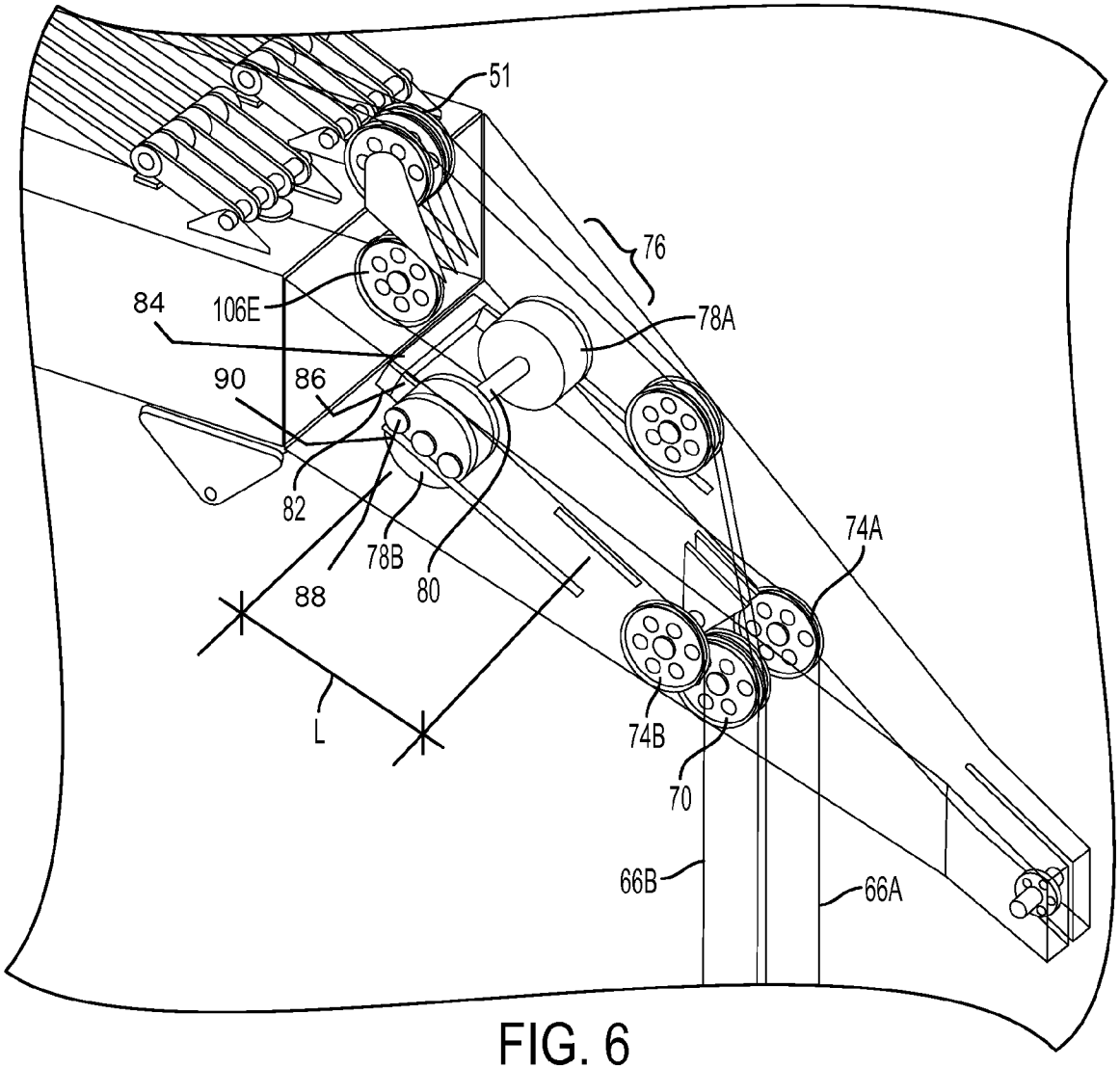
FIG. 6 is a close-up view of a boom tip of FIG. 3.

As shown in FIGS. 4-6, the equalizer 76 may include a pair of drums 78 (one for receiving each incoming line) arranged on opposite ends of a shaft 80 and the equalizer 76 may be arranged in a frame 82. The shaft 80 may define a central axis about which the drums 78 and the shaft 80 rotate substantially freely relative to the frame 82. The alignment sheaves 74 that the incoming lines 66 pass across when returning from the load block 72 may each be aligned vertically with the incoming line 66, but may be offset in height to accommodate the drum diameters of the equalizer 76. That is, as shown, the far alignment sheave 74A may be set relatively low allowing the incoming line 66A to pass across the alignment sheave 74A, extend to its respective equalizer drum 78A, pass under the drum 78A, and wrap upward and around the drum 78A. The near alignment sheave 74B may be set relatively high allowing the incoming line 66B to pass across the alignment sheave 74B, extend to its respective equalizer drum 78B, pass across the top of the drum 78B, and wrap downward around the drum 78B. Accordingly, the tension in the near line 66B may cause the equalizer 76 to tend toward clockwise rotation and the tension in the far line 66A may cause the equalizer 76 to tend toward counterclockwise rotation. The amount of tensile force in each of the lines 66A/66B may be made to be the same by the freely rotating equalizer 76. The equalizer 76 may be arranged in an equalizer frame 82 and coupled to the crane 50 for resisting the forces of each of the returning lifting lines 66A/66B. In the case of a crane 50 without a heave compensation system 100, the equalizer frame 82 may be rigidly secured to the boom tip 58. However, as will be described in more detail below, in the case of a crane 50 with heave compensation, the equalizer frame 82 may be secured to a heave line 104 that counteracts the forces of the two incoming lifting lines 66A/66B.

As shown in FIGS. 4-6, which show varying positions of the equalizer 76 and frame, the frame may be configured for supporting the equalizer 76 and guiding its heaving motion. As shown, the frame 82 may include a crossbar 84 extending generally across the boom tip 58 and a pair of outward reaching arms 86 may extend to the shaft or axle 80. The arms 86 may include a bore with a bearing assembly or other connection allowing the shaft 80 to pass through the distal portion of the arms 86. The shaft 80 may be free to rotate relative to the frame 82 about the longitudinal axis of the shaft 80. The equalizer drums 78 may be fixed to the shaft 80 and the shaft's freedom to rotate relative to the frame 82 may allow the equalizer 76 to balance the load in the lines 66A and 66B. The arms 86 or other portions of the frame 82 may include a guide or guides 88 arranged on an outer surface thereof to cause the equalizer 76 to track along a pathway as it oscillates to compensate for heaving motion. As shown, the frame 82 may include a plurality of rollers 88 on each end of the equalizer 76. The rollers 88 may be engaged in a track 90 arranged on the boom on each side of the equalizer 76. The track 90 may be arranged parallel to a line defined by the center of the shaft 80 and the bottom tangent to the sheave 106E. As such, the frame 82 and the equalizer 76 may be guided to move in a direction parallel to the distal end of the heave line 104 after it passes below sheave 106E. Accordingly, as the heave line 104 is paid out or hauled in, the equalizer 76 and frame 82 may naturally slide along the track 90 in an amount controlled by the pay out or inhaul amount of the heave line 104.

It is to be appreciated that, while an equalizer 76 with a horizontally oriented pivot axis has been described, an equalizer with vertical or other oriented axis may alternatively be provided. In still other embodiments, the incoming lines may pass around separate sheaves one or more times and the two ends of the incoming lines may be dead ended together. Several different approaches may be used to cause the tension in the incoming lines to balance. Where other arrangements of equalization are provided, the equalization system may be arranged on a frame the same or similar to the frame 82 described such that the heave compensation system may interact with the lifting lines via the incoming lines and the equalization system.

Turning now to the remote heave compensation system 100, reference is again made to FIGS. 1-3. As shown in these figures, the system 100 may include a compensator portion 102 arranged below the deck of a vessel, a heave line 104 secured to the compensator portion 102 and extending upward through the pedestal 54 and along the boom 56 via a series of sheaves 106. The heave line 104 may be secured to the equalizer frame 82 and may be configured for counteracting the tensile forces on the equalizer 76 from the two incoming lifting lines 66A/66B. The remote heave compensation system 100 may, thus, be configured to control the position of the equalizer 76 and compensate for heaving motion of the vessel while being isolated from the lifting lines 66A/66B. That is, the heave compensation system is not placed within the route of the lifting lines, but is, instead, coupled to one end thereof. Moreover, the end the system is coupled to is not the spool end, but is the opposite end of the lines. When the heaving motion of the vessel is in an upward direction, the remote heave compensation system 100 may pay out the heave line 104 thereby moving the equalizer 76 closer to the alignment sheaves 74 at the boom tip 58 and compensating for the upward motion of the vessel. In the opposite case, where the heaving motion of the vessel is in a downward direction, the remote heave compensation system 100 may haul in the heave line 104 thereby pulling the equalizer 76 away from the alignment sheaves 74 at the boom tip 58 and compensating for the downward motion of the vessel.

Figure 7:
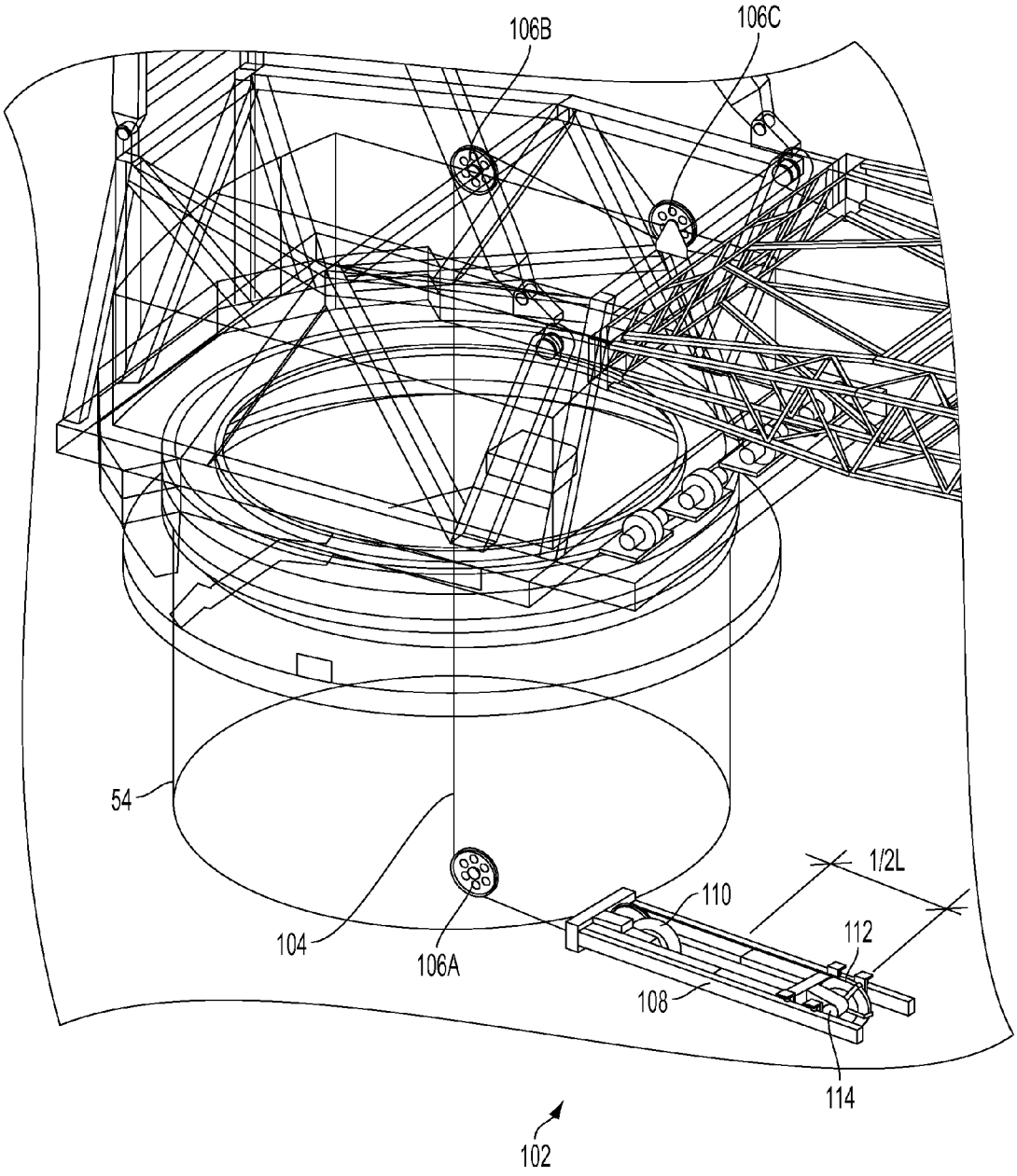
FIG. 7 shows a perspective view of the base of the crane of FIGS. 1-3, according to some embodiments.

With reference to FIG. 7, the compensator portion 102 may include a rack 108 secured to the vessel and supporting a heave line drum 110 and a compensator sheave 112. A supply of heave line 104 may be arranged on the heave line drum 110 and an outgoing portion of heave line 104 may extend away from the heave line drum 110, along the rack 108 to the compensator sheave 112. The heave line 104 may pass around the heave line sheave 112 and a returning portion may pass back along the rack 108, past the heave line drum 110, and to a sheave 106A arranged at or near the center of the pedestal 54 where the heave line 104 may extend upward toward the base 52 of the crane 50. The compensator sheave 112 may be supported by a frame 114 configured for sliding along the rack 108. The frame 114 may be slidably secured in the rack 108 and may be operably coupled to one or more actuators for controllably reciprocating the frame 114 along the rack 108. A computer monitoring system may be provided for monitoring the heaving motion of the vessel and translating the frame 114 and compensator sheave 112 along the rack 108 by a distance configured for compensating for the heave motion.

It is noted that the outgoing and returning arrangement of the heave line 104 in the heave compensator 102 may allow for double the output of a straight line compensation system. That is, for any distance L that the compensator sheave 112 translates along the rack 108, the compensator 102 will payout or haul in a length of heave line 104 equal to 2 L. Accordingly, for example, if the compensator sheave 112 translates 1 meter, then 2 meters of heave line 104 will be paid out causing the equalizer 76 to translate at the boom tip 58 by a distance of 2 meters. The outgoing and incoming nature of the lifting lines 66 shown will cause the load block 72 at the bottom of the lifting lines 66 to translate by 1 meter, a distance equal to the compensator sheave translation distance. Accordingly, the heave compensator portion 102 of the system may have a stroke length of ½L where L is the stroke length available at the boom tip 58 for the equalizer 76, as shown in FIGS. 4-6. Where other arrangements of heave compensators 102 are used or where other arrangements of lifting lines 66 are used, differing relationships between the compensation distance and the load block travel distance may be provided.

The heave line 104 may be a substantially strong line extending from the compensator portion 102 described upward through the pedestal 54, along the boom 56, and to the equalizer 76 near the boom tip 58. In the present embodiment, the heave line 104 may be approximately 2 times as strong as the lifting lines 66 because the heave line 104 may counteract the forces placed on the equalizer 76 by the two incoming lifting lines 66. Where other arrangements of lifting lines 66 are used, other capacities of heave line 104 may be provided. In one embodiment, the heave line 104 may be a 90 mm diameter rope having a capacity of 695 MT B.S. Other diameters and strengths of heave line 104 may also be provided.

As mentioned, the heave line 104 may extend from the compensator portion 102 of the system 100 to a sheave 106A arranged below the deck of the vessel near the center of the pedestal 54 and at or near the axis of rotation of the crane 50. The heave line 104 may then extend upwardly to a center sheave 106B arranged substantially directly above the below-deck sheave 106A. The heave line 104 may pass across the top of the center sheave 106B, and may extend radially outward across the crane base 52 to a sheave 106C arranged at or near the pivotal axis of the boom 56. The heave line 104 may pass across the bottom of the sheave 106C at the pivotal axis of the boom 56 and then the heave line 104 may extend along the length of the boom 56.

The location of the heave line 104 as it extends from below the vessel deck, up the pedestal 54 and radially outward to the boom pivot axis is advantageous because the crane 50 is free to rotate without entangling the heave line 104. That is, as the crane 50 rotates about its base 52, the portion of the heave line 104 extending along the boom 56 may rotate about the base 52 together with the boom 56. The sheave 106C near the pivot axis of the boom 56 and the sheave 106B at the center of the base 52 may rotate about the center of the base 52 keeping the radially extending portion of the heave line 104 in-line with the portion extending along the boom 56. The portion of the line 104 extending downward through the pedestal 54 may twist as the crane 50 rotates, but because it extends along the rotational axis of the crane 50, the line 104 may remain aligned with the center sheave 106B and the sheave 106A arranged below the vessel deck.

As the heave line 104 extends along the length of the boom 56 toward the boom tip 58, an offsetting sheave 106D may be provided at or near the mid-length of the boom 56 and the heave line 104 may pass across the top of the offsetting sheave 106D. As the heave line 104 reaches the boom tip 58, the heave line 104 may pass across the top of a ridge sheave 51 together with the pair of outgoing lift lines 66. As the heave line 104 passes across the top of the ridge sheave 51 it may continue around the ridge sheave 51, as shown in FIGS. 4-6, downward to a lower sheave 106E. The heave line 104 may pass along an inboard side of the lower sheave 106E, across the bottom of the lower sheave 106E and outward to the equalizer frame 82. The heave line 104 may be dead ended into the equalizer frame 82 and secured thereto.

In operation, before the remote heave compensation system 100 is activated, the equalizer 76 may be arranged in a distal most position along the boom tip 58, as shown in FIGS. 1 & 4, and the heave compensator sheave 112 may be arranged along the rack 108 at a point substantially close to the heave line drum 110. When the remote compensation device is activated, the compensator sheave 112 may be caused to translate away from the compensator drum 110 by a distance of approximately ¼ of the stroke length, L, such that the equalizer 76 translates in an inboard/proximal direction of ½ L. This positions the equalizer 76 in a centered position along its available stroke length, as shown in FIGS. 2 & 5, and postures the equalizer 76 suitably for beginning to compensate for heaving motions. The monitoring system of the compensator portion 102 of the heave compensation system 100 may then monitor the heaving motion of vessel. As the vessel moves upward, the monitoring system may signal the actuators to translate the heave compensation sheave 112 along the rack 108 toward the compensator drum 110 such that heave line 104 is paid out from the compensator 102. The paid out heave line 104 may then allow the equalizer 76 to translate distally from its center point closer to the boom tip 58. As the upward heaving motion subsides, the compensator 102, the heave line 104, and the equalizer 76 may slow their direction of movement and as the vessel begins a downward motion, the system 100 may reverse the motion of the heave compensator sheave 112 moving it away from the compensator drum 110 and hauling in a portion of the heave line 104. The inhauling of the heave line 104 draws the equalizer 76 back inward along the boom tip 58 and compensating for the downward motion of the vessel and causing the equalizer 76 to travel to an inner position (FIGS. 3 and 6). While use of the full stroke is shown, the amount of stroke used in the compensation process may depend on the amount of heave experienced by the vessel.

Although the present invention has been described with reference to preferred embodiments, persons skilled in the art will recognize that changes may be made in form and detail without departing from the spirit and scope of the invention.

What is claimed is:

1. A remote heave compensation system comprising:

a heave compensator configured for arrangement at a remote location from a crane and configured to translate in association with and to compensate for heaving motion of a vessel supporting the crane;

an equalizer configured for arrangement on the crane and further configured for coupling to an end of a multiline lifting and lowering system of the crane; and a heave line, separate from the multiline lifting and lowering system of the crane, secured to the equalizer at a first end, configured for extending along a portion of the crane and off of the crane to the remote location of the heave compensator, and secured to the heave compensator at a second end, wherein, compensating motion of the heave compensator is transferred to the equalizer by the heave line to compensate for heaving motion of the vessel and stabilize objects suspended from the multiline lifting and lowering system of the crane.

2. The remote heave compensation system of claim 1, wherein the multiline lifting and lowering system is a deep water lowering system.

3. The remote heave compensation system of claim 2, wherein the deep water lowering system comprises a pair of line spools where each spool comprises an outgoing line extending up a boom of the crane, down to a load block and returning to the equalizer on the crane.

4. The remote heave compensation system of claim 3, wherein a first of the outgoing lines is a right lay line and a second of the outgoing lines is a left lay line.

5. The remote heave compensation system of claim 1, wherein the heave compensator comprises a heave line drum having a supply of heave line and a compensator sheave arranged along the heave line and configured for taking up or releasing heave line from the heave compensator.

6. The remote heave compensation system of claim 5, wherein the compensator sheave is arranged on a rack and the heave line extends from the heave line drum, around the compensator sheave and generally passes back along the line extending to compensator sheave, wherein motion of the compensator sheave along the rack causes the taking up or releasing of the heave line.

7. The remote heave compensation system of claim 6, wherein the heave line extending to the compensator sheave is generally parallel to the line leaving the heave line sheave such that an amount of heave line that is taken up or released is equal to approximately twice the amount of motion of the compensator sheave.

8. The remote heave compensation system of claim 1, wherein the crane includes a central vertical axis about which the crane pivots and the heave line extends to the crane substantially parallel to and in close proximity to the central vertical axis.

9. The remote heave compensation system of claim 1, wherein the equalizer comprises a pair of drums, each drum secured to one end of one of the lines of the multiline system.

10. The remote heave compensation system of claim 9, wherein the lines are wrapped around the drums to induce rotational motion in each drum in a direction opposite to the other thereby equalizing the loads in the lines of the multiline system.

11. A crane having a heave compensation system, comprising:

a base;

a crane boom extending from the base;

a multiline system arranged on the crane for raising and lowering objects from the crane boom; and a remote heave compensation system associated with the crane boom and comprising:

a heave compensator arranged at a remote location from the crane boom and configured to translate in association with and to compensate for heaving motion of a vessel;

an equalizer arranged on the crane boom and coupled to an end of the multiline system;

a heave line, separate from the multiline system of the crane, secured to the equalizer at a first end, extending along a portion of the crane boom and off of the crane boom to the remote location of the heave compensator, and secured to the heave compensator at a second end, wherein, compensating motion of the heave compensator is transferred to the equalizer by the heave line to compensate for heaving motion of the vessel and stabilize objects suspended from the multiline system.

12. The crane of claim 11, wherein the heave compensator comprises a heave line drum having a supply of heave line and a compensator sheave arranged along the heave line and configured for taking up or releasing heave line from the heave compensator.

13. The crane of claim 12, wherein the compensator sheave is arranged on a rack and the heave line extends from the heave line drum, around the compensator sheave and generally passes back along the line extending to compensator sheave, wherein motion of the compensator sheave along the rack causes the taking up or releasing of the heave line.

14. The crane of claim 13, wherein the heave line extending to the compensator sheave is generally parallel to the line leaving the heave line sheave such that an amount of heave line that is taken up or released is equal to approximately twice the amount of motion of the compensator sheave.

15. The crane of claim 11, wherein the crane includes a central vertical axis about which the crane pivots and the heave line extends to the crane substantially parallel to and in close proximity to the central vertical axis.

16. The remote heave compensation system of claim 11, wherein the equalizer comprises a pair of drums, each drum secured to one end of one of the lines of the multiline system.

17. The remote heave compensation system of claim 16, wherein the lines are wrapped around the drums to induce rotational motion in each drum in a direction opposite to the other thereby equalizing the loads in the lines of the multiline system.

* * * * *